US007445467B1

(12) United States Patent
Matsuo

(10) Patent No.: US 7,445,467 B1
(45) Date of Patent: Nov. 4, 2008

(54) BOARD ELECTRICAL CONNECTOR, AND ELECTRICAL CONNECTOR ASSEMBLY HAVING BOARD ELECTRICAL CONNECTOR AND MIDDLE ELECTRICAL CONNECTOR

(75) Inventor: Tsutomu Matsuo, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/987,318

(22) Filed: Nov. 29, 2007

(51) Int. Cl.
*H01R 12/00* (2006.01)

(52) U.S. Cl. ..... 439/74; 439/637

(58) Field of Classification Search ..... 439/74, 439/262, 630, 636, 637, 608
See application file for complete search history.

(56) References Cited

U.S. PATENT DOCUMENTS 3,530,422 A * 9/1970 Goodman ..... 439/62
5,013,264 A * 5/1991 Tondreault ..... 439/636
5,082,459 A * 1/1992 Billman et al. ..... 439/637
5,387,133 A * 2/1995 Tondreault et al. ..... 439/637
5,711,690 A * 1/1998 Thrush et al. ..... 439/862
6,241,558 B1 * 6/2001 Mosquera ..... 439/660
6,336,829 B2 * 1/2002 Matsukawa ..... 439/660
6,341,966 B1 * 1/2002 Takada et al. ..... 439/108
6,695,622 B2 * 2/2004 Korsunsky et al. ..... 439/65
7,044,748 B2 * 5/2006 Korsunsky et al. ..... 439/74
7,338,291 B2 * 3/2008 Takada ..... 439/65

FOREIGN PATENT DOCUMENTS

JP 2005-216695 8/2005

* cited by examiner

*Primary Examiner*—Thanh-Tam T Le
(74) *Attorney, Agent, or Firm*—Kubotera & Associates, LLC

(57) ABSTRACT

A board electrical connector includes a plurality of the terminals provided in a housing. The terminals are attached to a circuit board on one side of the housing and fit each other with a middle connector on the other side of the housing. The terminals contact with pad portions of middle members of the middle connector. A receiving groove having an opening portion to receive an edge portion of the middle member of the middle connector is provided in the housing. A contact portion of the terminal enters the receiving groove for contacting with the middle member with a contact pressure. A protrusion having a smaller entry amount than that of the contact portion is provided on an inner wall surface of the receiving groove in a receiving direction of the receiving groove. The protrusion is situated at the same position as that of the contact portion.

17 Claims, 5 Drawing Sheets

BOARD ELECTRICAL CONNECTOR, AND ELECTRICAL CONNECTOR ASSEMBLY HAVING BOARD ELECTRICAL CONNECTOR AND MIDDLE ELECTRICAL CONNECTOR

BACKGROUND OF THE INVENTION AND RELATED ART STATEMENT

The present invention relates to a board electrical connector attached to a circuit board, and an electrical connector assembly having the board electrical connector and a middle electrical connector.

A conventional electrical connector assembly comprises a middle electrical connector (middle connector) and a board electrical connector (board connector). The electrical connector assembly of Patent Reference, for example, has been known. In the Patent Reference, the middle connector is provided with a plurality of middle members having a plate shape. The middle members are supported with a housing. Further, pads or connection portions are arranged along two edge portions of the middle members facing each other.

When the middle connector fits into the board electrical connector, the contact portions of the terminals of the board connectors are connected to the pads.

Patent Reference Japanese Patent Publication No. 2005-216695

The terminal of the board electrical connector is branched into two, and distal portions of the branched terminal have contact portions. The two contact portions elastically contact with the pad portions of the middle member from the both sides of the middle member.

In the assembly of the middle connector and the board connectors, even though the both connectors are fitted and somewhat displaced in a thickness direction of the middle member or receive an external force in the direction after fitting, at least one of the two contact portions of the terminals always contacts with the pad of the middle member through contact pressure. Accordingly, an electrical connection becomes stable.

Patent Reference Japanese Patent Publication No. 2005-216695

In the connector assembly of Patent Reference, each of the terminals has the contact portion branched into the two sides of the middle member for connection with the pad of the middle member. Accordingly, different terminals may not be arranged on the both sides of the middle member in the same position in a terminal arrangement direction. That is, the number of the terminals of the entire connector is reduced in half.

When each of the terminals of Patent Reference is simply branched into two, it is possible to increase the number of the terminal. However, when the connectors are fitted into each other to displace in one direction in a thickness direction of the middle member or when the connectors receive external force in the direction when or after the connectors are fitted into each other, the contact pressure of the terminal of the other surface may not be enough and the contact may become unstable or may be lost even though the terminal provided on one of the surfaces of the terminal of the middle member contacts with the middle member having enough contact pressure.

Further, in the terminal of the other surface, if a displacement of the thickness direction at the fitting of the connectors faces the other direction, the contact becomes unstable or may be lost.

In view of the problems described above, an object of the present invention is to provide a board electrical connector and an electrical connector assembly having the board connector and a middle connector.

In the connectors, even though the connectors are displaced upon fitting in a thickness direction of the middle connector or the connector receives an external force in the direction after fitting, the terminal can contact with the middle member with an enough contact pressure.

Further objects and advantages of the invention will be apparent from the following description of the invention.

SUMMARY OF THE INVENTION

In order to attain the objects described above, according to the present invention, a board electrical connector includes a plurality of the terminals provided in a housing. The terminals are attached to a circuit board on one side of the housing and fit each other with a middle connector on the other side of the housing. Further, the terminals contact with pad portions of middle members of the middle connector.

In the board electrical connector according to the present invention, a receiving groove having an opening portion to receive an edge portion of the middle member of the middle connector is provided in the housing. Further, a contact portion of the terminal of the board electrical connector enters an inside of the receiving groove and is situated in a position, so that the contact portion can contact with the middle member with a contact pressure.

Further, a protrusion having a smaller entry amount than that of the contact portion is provided on an inner wall surface of the receiving groove in a receiving direction of the receiving groove of the middle member. The protrusion is situated at the same position as that of the contact portion.

When the board electrical connector with the configuration described above is displaced in a horizontal direction perpendicular to the fitting direction or a contact pressure direction of the terminal against the middle member of the middle connector upon fitting with the mating middle connector, or when the connectors receive an external force in the horizontal direction after fitting even though the connectors are fitted with no displacement in the horizontal direction, the terminal can be elastically displaced in a direction in which the contact pressure is increased to a position where the contact portion is lower than the inner wall surface of the receiving groove.

In the board electrical connector according to the present invention, the protrusion is provided. Accordingly, when there is the displacement upon fitting or when an external force is received after fitting, the protrusion prevents the middle member from being displaced. Further, in the position in which the displacement is prevented, the contact portion elastically contacts with the middle member. When the displacement is in the opposite direction, the contact portion follows the middle member to maintain an elastic contact within a pre-compression range until the contact portion is adjacent to the inner wall surface of the receiving groove on the other side in a direction in which the contact pressure of the terminal decreases.

In the receiving direction of the middle member according to the present invention, the contact portion and the protrusion are situated at the same position. Accordingly, the protrusion functions as a supporting point for the middle member and the middle member may slope around the supporting point. Thus, the displacement in a horizontal direction between the middle connector and the circuit board side connector is further allowed. Further, a corresponding range is widened against the displacement upon fitting in the horizontal direction and external force after fitting.

According to the present invention, the contact portion and the protrusion do not have to be at exactly the same position in the receiving direction of the middle member. Alternatively, the contact portion and the protrusion may be substantially at the same position in which the contact portion and the protrusion overlap in the direction.

According to the present invention, the protrusion may be provided between the terminals adjacent to each other in a terminal arrangement direction. Accordingly, the protrusion is located between the terminals adjacent to each other. Thus, the contact pressure at the protrusion and the middle member is eased. Further, the protrusion contacts with the middle member evenly in the terminal arrangement direction, and the position of the middle member is to be stable. Further, the contact pressure between the pad portion and the terminal becomes stable.

According to the present invention, the terminal may be provided on the both inner wall surface sides of the receiving groove to correspond to the pad portion. The pad portion is provided on the both surfaces of the middle member of the middle connector. Accordingly, the number of the terminals increases.

Further, since the terminal can contact with the both surfaces of the middle member of the middle connector, the contact pressure of the terminal can be maintained regardless of the displacement upon fitting in the horizontal direction and a direction of external force in the horizontal direction after fitting. Thus, the contact becomes stable.

According to the present invention, it is preferred that the terminals of the both inner wall surface sides of the receiving groove are situated alternatively in a terminal arrangement direction. Accordingly, the contact pressure of the both directions becomes even in the terminal arrangement direction.

The electrical connector assembly according to the present invention has the middle connector and the board connectors. The middle connector supports a plurality of the middle members in the middle housing. In the middle member, a plurality of the pad portions is arranged along the two edge portions of the board parallel to and facing each other.

Further, in the middle member, the corresponding pad portions in the both edge portions are conducted each other in the lead portion. In the board electrical connector, a plurality of the terminals is arranged in the housing to contact with the pad portions of the middle member. The terminals are attached to the circuit board on one side and fitted to the middle connector each other on the other side.

In the electrical connector assembly according to the present invention, the board electrical connector is provided with the receiving groove in the housing. The receiving groove has an opening to receive one edge portion of the middle member of the middle connector.

The contact portion of the terminal of the board electrical connector enters the inside of the receiving groove and is situated to contact with the middle member through contact pressure. On the inner wall surface of the receiving groove, the protrusion having a smaller entry amount than that of the contact portion is provided at the same position as the contact portion in the receiving direction to the receiving groove of the middle member.

According to the present invention, one of the surfaces of the middle member of the middle connector may be provided with the pad portion and the other surface is provided with the shielding plate. Further, one of the inner wall surfaces of the receiving groove of the board electrical connector may be provided with the terminals that contact with the pad portion, while the other inner wall surface of the receiving groove is provided with the terminals that contact with the shielding plate.

The shielding plate provided on the other surface effectively shields the circuit portion conducting with the pad portion provided on the other surface. The terminal of the board electrical connector that contacts with the shielding plate functions as the grounding terminal. In this case, a contact between the grounding terminal and the shielding plate can effectively deal with the displacement upon fitting of the connectors in the horizontal direction and an external force after fitting in the direction. Further, the contact is always elastic.

As explained above, in the present invention, the contact portion of the terminal contacts with the middle member received in the receiving groove with contact pressure. Even though the middle member is displaced upon fitting of the connectors in a direction of the contact pressure direction or receives an external force after fitting in the direction, the contact portion elastically contacts with the middle member in a direction in which the contact pressure increases.

In addition, the protrusion provided on the inner wall surface of the receiving groove contacts with the middle member. Accordingly, further displacement of the middle member is regulated and the contact pressure of the contact portion is secured. The protrusion functions as a supporting point for the middle member, and the middle member may be sloped around the protrusion. Accordingly, the displacement of the middle connector and the connector on the board side upon fitting and a width to react to the external force after fitting may be further increased.

Further, even though the middle member is displaced in the other direction, the contact portion follows the middle member in the direction in which the contact pressure is reduced while maintaining the contact pressure. In this case, in the middle member, further displacement is regulated on the other inner wall surface of the receiving groove. Accordingly, the contact pressure is maintained.

In the present invention, when the terminal and the protrusion are arranged on the both surfaces of the middle member symmetrically, most impacts of the displacement of the middle member in the thickness direction upon fitting of the connectors and the displacement due to an external force after fitting are balanced out in both directions and will be neutralized.

DETAILED DESCRIPTION OF THE PREFERRED EMBODIMENTS

Hereunder, embodiments of the present invention will be explained with reference to the accompanying drawings.

Figure 1:
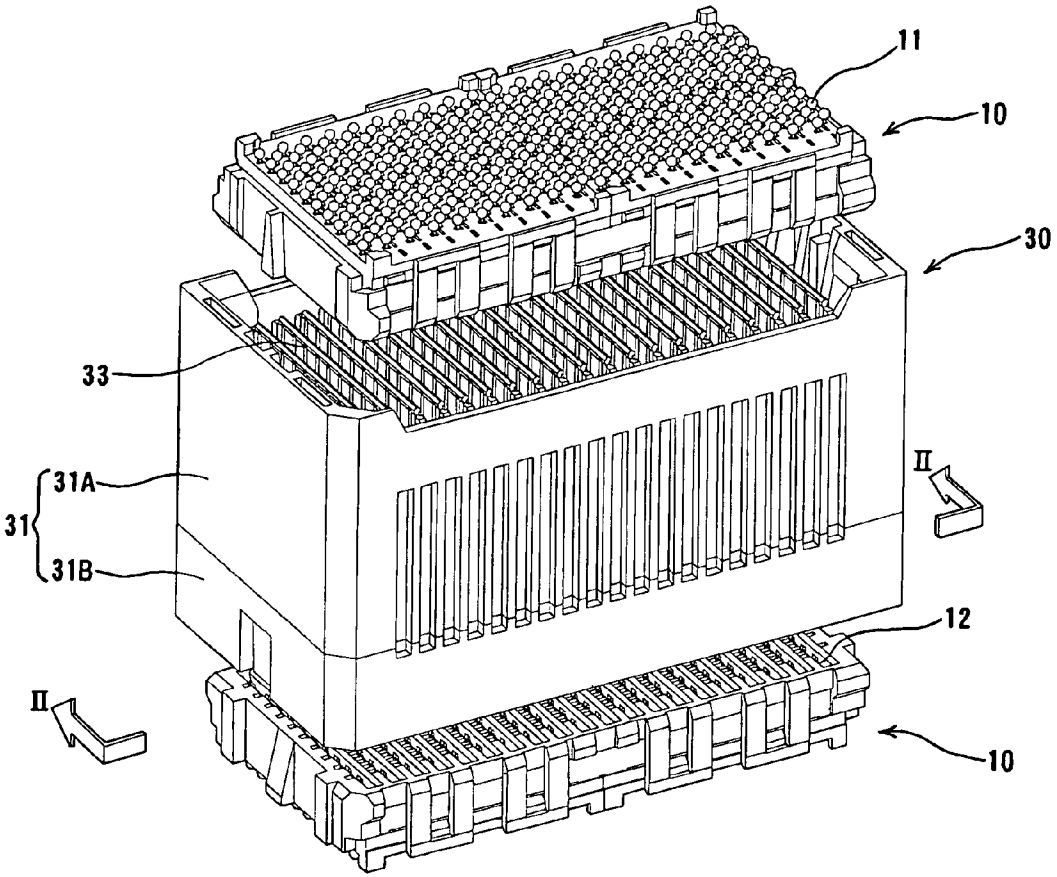
FIG. 1 is a plan view showing a middle electrical connector and board connectors to be connected thereto according to an embodiment of the present invention.

FIG. 1 is a perspective view of board electrical connectors 10 and a middle connector 30 before fitting according to an embodiment. In the embodiment shown in FIG. 1, the board connectors 10 having an identical configuration are situated symmetrically above and below the middle connector 30. A top surface of the top board electrical connector 10 and a bottom surface of the bottom board electrical connector 10 are provided with solder balls 11 in connection portions for terminals.

In the embodiment, the solder balls 11 connect the board connectors 10 with circuit boards (not shown). The board electrical connector 10 is provided with a plurality of receiving grooves 12 (refer to the bottom board electrical connector 10) on an opposite side of the side having the solder balls 11. A middle member 33 of the middle connector is inserted into the receiving groove 12.

A housing 31 of the middle connector 30 has a top member 31A and a bottom member 31B. The top member 31A and the bottom member 31B are connected. Grooves 32 (shown in FIG. 2) are provided in the housing 31 at positions corresponding to the receiving grooves 12 of the board electrical connector 10. The middle member 33 having a plate shape of the middle connector 30 is inserted into the grooves 32.

After each of the board connectors 10 is connected to the circuit board, the board connectors 10 fit into the middle connector 30. Accordingly, the board connectors 10 connected to the circuit boards are electrically connected through the middle members of the middle connector 30.

Figure 2:
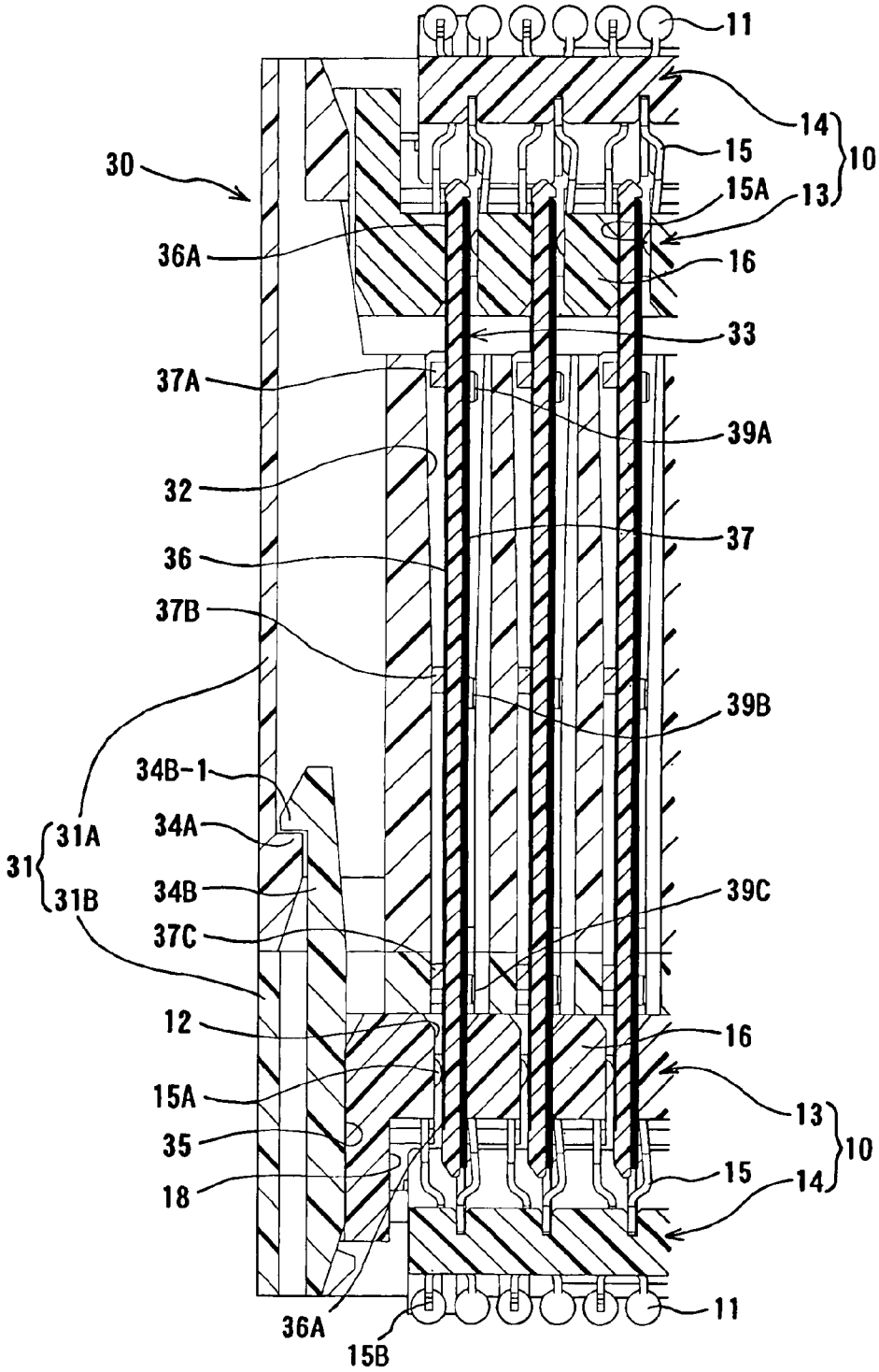
FIG. 2 is a sectional view of the middle electrical connector according to the embodiment of the present invention.

An inner configuration and an engagement state of the board connectors 10 and the middle connector 30 will be explained referring to FIG. 2. FIG. 2 is a sectional view taken along a line II-II in FIG. 1. FIG. 2 is a partial enlarged sectional view. The middle connector 30 has the middle members 33 as many as shown in FIG. 1. A right portion and a left portion of the middle connector 30 are symmetrical.

In FIG. 2, the configurations of the board connectors 10 at a top portion and a bottom portion are identical. Further, one of the board connectors 10 is simply situated upside down. Accordingly, only the board electrical connector 10 at a bottom portion will be explained below.

Figure 3:
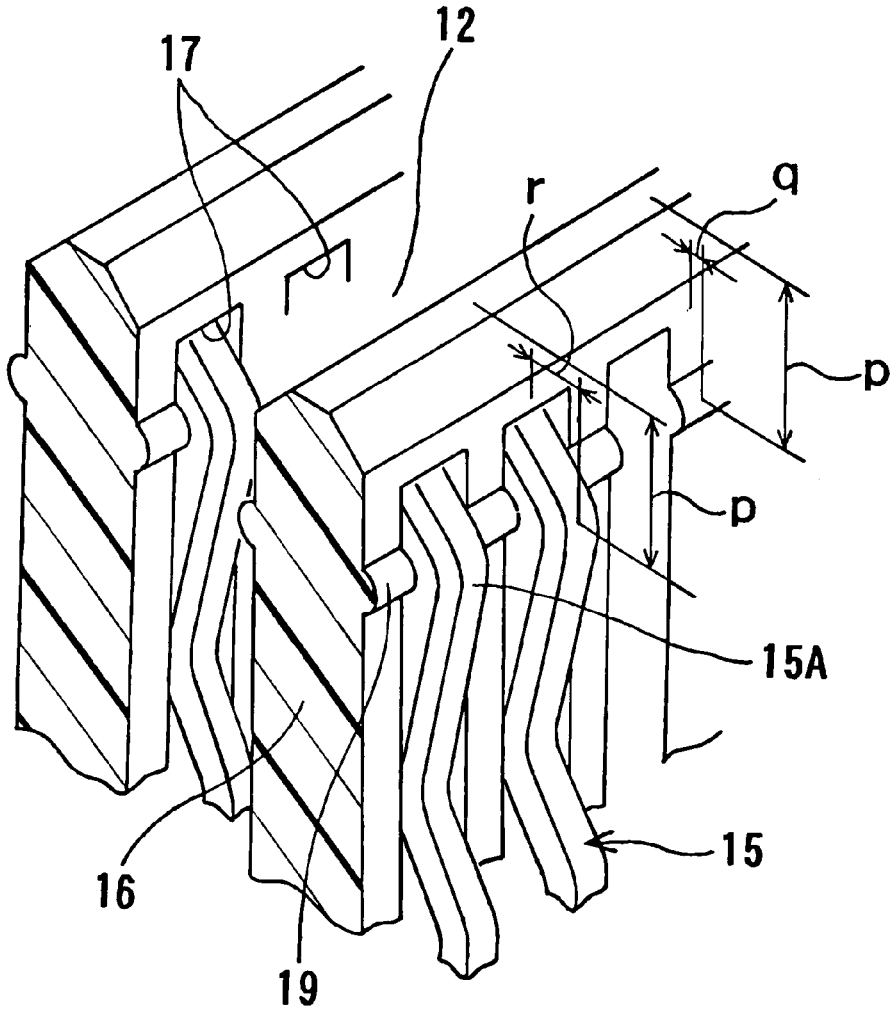
FIG. 3 is a perspective view showing a middle member of the middle electrical connector according to the embodiment of the present invention.

In the board electrical connector 10, a housing body 13 and a terminal holding body 14 to hold terminals 15 are connected. As shown in FIG. 1, the solder balls 11 are arranged in two directions perpendicular to each other on an upper surface or a lower surface of the connector. Similarly, the terminals 15 are arranged in two directions perpendicular to each other. In FIG. 2, only the terminals 15 arranged in a horizontal direction are shown. In FIG. 3, the terminals 15 arranged in the two directions are shown.

A plurality of the receiving grooves 12 is provided in the housing body 13 at a specific interval in a horizontal direction. The receiving grooves 12 extend in a direction perpendicular to a sheet surface and pass through top to bottom in FIG. 2. The two adjacent receiving grooves 12 form a dividing wall 16 therebetween. The receiving groove 12 receives an edge portion of the middle member 33 of the middle connector 30.

Each of the dividing walls 16 is provided with a groove 17 (shown in FIG. 3) buried in a plate thickness direction of the dividing wall 16. The groove 17 has an opening downwardly at a specific interval in a direction perpendicular to the sheet surface. Further, a lower surface of the housing body 13 is provided with a recess portion 18 to accommodate and hold the terminal holding body 14.

The terminal 15 held by the terminal holding body 14 extends top to bottom. The terminal 15 has a contact portion 15A at a top thereof and a connection portion 15B having the solder ball 11 at a bottom thereof. When the terminal holding body 14 is accommodated to and held at the recess portion 18, a large part of the top portion of the terminal 15 is accommodated to the groove 17 of the dividing wall 16. When the top portion of the terminal becomes free, the contact portion 15A enters the receiving groove 12 (shown in FIG. 3).

The contact portion 15A is bent to form a raised shape. In the embodiment, the two terminals 15 adjacent to each other in a horizontal direction in FIG. 2 are symmetrically arranged in a direction in which the top portions of the contact portions 15B having raised shapes approach each other. Further, the two terminals 15 adjacent to each other are situated on the both inner wall sides of the receiving grooves 12. The contact portions 15A of the two terminals 15 elastically compress the middle member 33 having a plate shape described below.

In a direction that the receiving groove 12 extends or perpendicular to the sheet surface in FIG. 2, the terminals 15 situated in the both inner wall surface sides of the receiving groove 12 are alternatively arranged in the direction. Accordingly, the grooves 17 that accommodate the top portions of the terminals 15 having the contact portions 15A are alternatively arranged in the direction perpendicular to the sheet surface on the both inner wall surfaces of the receiving groove 12.

The inner wall surfaces of the receiving groove 12 are provided with protrusions 19 having an approximate half cylinder shape as shown in FIG. 3. The receiving groove 12 is formed with the dividing walls 16. The grooves 17 are provided at an interval in the dividing wall 16. The protrusions 19 are situated between the grooves 17 or between the contact portions 15A of the terminals 15 accommodated to the grooves 17.

As shown in FIG. 3, the protrusion 19 is situated at the same position as the top portion of the contact portion 15A of the terminal 15 in a top-to-bottom direction or an entry direction of the middle member 33 to the receiving groove 12 (both are situated in a distance p away from an upper edge surface of the dividing wall). An entry amount q of the protrusion 19 from the inner wall surface of the receiving groove 12 to an inside of the receiving groove 12 is smaller than an entry amount r of the contact portion 15A.

The middle connector 30 holds the middle members 33 in grooves 32 provided in the housing 31. As shown in FIG. 2, the housing 31 comprises the top member 31A and the bottom member 31B. The top member 31A and the bottom member 31B are connected to form the housing 31 through an engagement of a step engagement portion 34A provided in the top member 31A and a nail portion 34B-1 of an elastic engagement arm 34B. The elastic engagement arm 34B extends from the bottom member 31B. The housing 31 is provided with fitting recess portions 35 for the board electrical connector 10 to fit into.

When the board electrical connector 10 fits into the fitting recess portions 35, the receiving grooves 12 of the board electrical connector 10 communicate with the grooves 32 that pass through the top member 31A and the bottom member 31B top to bottom. As shown in FIG. 2, a groove width of the groove 32 becomes slightly wider upwardly. Accordingly, the middle member 33 can be inserted into the groove 32 from above with ease and a slope of the middle member may be tolerated.

As shown in FIG. 2, the middle member 33 has a plate shape having a width extending top to bottom in a direction perpendicular to the sheet surface. One of the surfaces of the middle member (a left surface in FIG. 2) has a terminal 36, while the other surface (a right surface in FIG. 2) has a shielding plate 37. The terminal 36 is formed of a band-like member having a long shape top to bottom. A plurality of the terminals 36 is provided with an interval in a width direction of the middle member 33. The terminal 36 extends to near top and bottom edges of the middle member 33 and conducts with a pad portion 36A in top and bottom edge portions.

The middle member 33 is provided with protrusion portions 37A, 37B and 37C in top, middle, and bottom positions of the left surface of the middle member 33, respectively. The protrusion portions 37A, 37B and 37C extend in a width direction of the middle member 33. The protrusion portions 37A, 37B and 37C are provided with holding holes (not shown) passing through top to bottom in the left surface of the middle member 33. Each of the terminals 36 is pressed to fit into the holding holes of the protrusion portions 37A, 37B and 37C to pass through and held there.

The shielding plate 37 covers substantially the entire right surface of the middle member 33 and held by a plurality of protrusions 39A, 39B, and 39C.

As described above, when the middle member 33 having the terminal 36 and the shielding plate 37 is inserted into the groove 32 of the housing 31 from above, the middle member 33 is pressed to fit into and held at the groove 32 through a protrusion portion 37B and the protrusion 39B in a middle portion and a protrusion portion 37C and the protrusion 39C in a bottom portion. Thus, the middle member 33 is not adjacent to the inner wall surface of the groove 32 in the upper portion in which a groove width of the groove portion 32 is slightly widening. Accordingly, the middle member 33 is not displaced.

When the middle member 33 is incorporated into the housing 31, the top and bottom edge sides of the middle member 33 protrude from a bottom surface of the fitting recess portion 35 of the housing 31. Further, when the board electrical connector 10 fits into the fitting recess portion 35, the middle member 33 is situated to enter the inside of the receiving groove 12 of the board electrical connector 10. When the top and bottom edge sides of the middle member 33 enter the inside of the receiving groove 12 of the corresponding board electrical connector 10, a pad portion 36A of the terminal 36 and the edge portion of the shielding plate 37 contact with the contact portion 15A of the corresponding terminal 15 of the board electrical connector 10.

Next, the board electrical connector 10 and an operation of the middle connector 30 fitted into the board electrical connector 10 according to the embodiment will be explained.

When the middle connector 30 fits into the board electrical connector 10 in a regular and ideal position in a contact pressure direction of the terminal, the middle member 33 of the middle connector 30 is situated inside of the receiving groove 12 of the board electrical connector 10 in a center of a width direction thereof.

Further, the pad portion 36A of the middle member 33 contacts with the two contact portions 15A of the terminals 15 of the board electrical connector 10 at the equal contact pressure. The contact, portions 15A of the two terminals 15 are facing each other. That is, the middle member 33 is situated in a neutral position inside of the receiving groove 12.

Further, since the entry amount q of the protrusion 19 into the inside of the receiving groove 12 is smaller than the entry amount r of the contact portion 15A, the protrusion 19 does not contact with the middle member 33. The protrusion 19 is provided on the inner wall surface of the receiving groove 12.

On the other hand, when the middle connector 30 fits into the board electrical connector 10 at a displaced position in a contact pressure direction of the terminal or receives external force in the direction after fitting at a regular position, the middle member 33 is situated at a displaced position from the neutral position inside of the receiving groove 12.

At the displaced position, the contact pressure becomes large in one part of the terminal 36 of the middle member 33 and the shielding plate 37 and small in the other part. When the displacement is minimal, the middle member 33 moves in a direction that the contact pressure difference corrects the displacement and held at a position that no contact pressure exists.

When the displacement is large, the contact pressure difference may not be enough to correct the position of the middle member 33. Rather, the middle member 33 is adjacent to the protrusion 19 of the inner wall surface of the receiving groove 12 before the contact pressure difference is increased and receives a reaction force from the protrusion 19.

Figure 4:
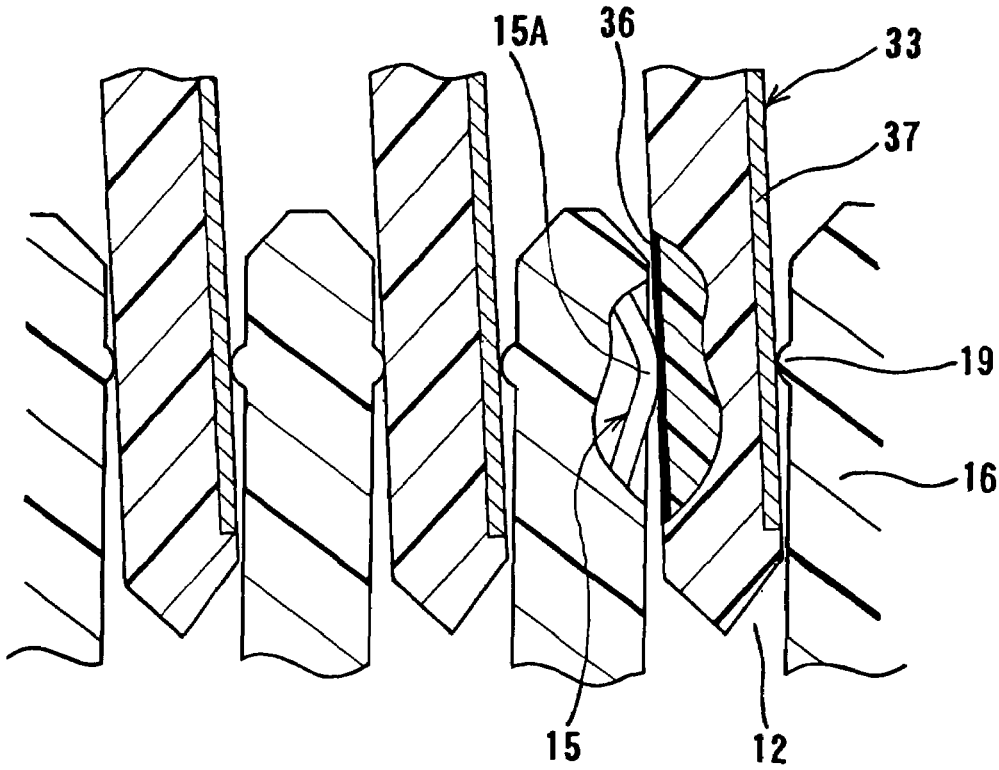
FIG. 4 is a sectional perspective view showing a terminal arrangement plate of the middle member of the middle electrical connector according to the embodiment of the present invention.

The reaction force and the contact pressure of the contact portion 15A are balanced and the middle member 33 is held at the position. In this case, the contact portion 15A and the protrusion 19 are situated at the same position in a fitting direction of the connectors. Accordingly, as shown in FIG. 4, the protrusion 19 functions as a supporting point against the middle member 33, and the middle member 33 can be inclined around the protrusion 19. Thus, the allowable displacement width of the middle member 33 is increased for an amount of the slope.

The present invention is not limited to the embodiments shown in FIGS. 1 to 4. Various modifications may be possible. For example, a shape, a size, and a position of the protrusion provided on the inner wall surface of the receiving groove of the board electrical connector may be varied.

Figure 5:
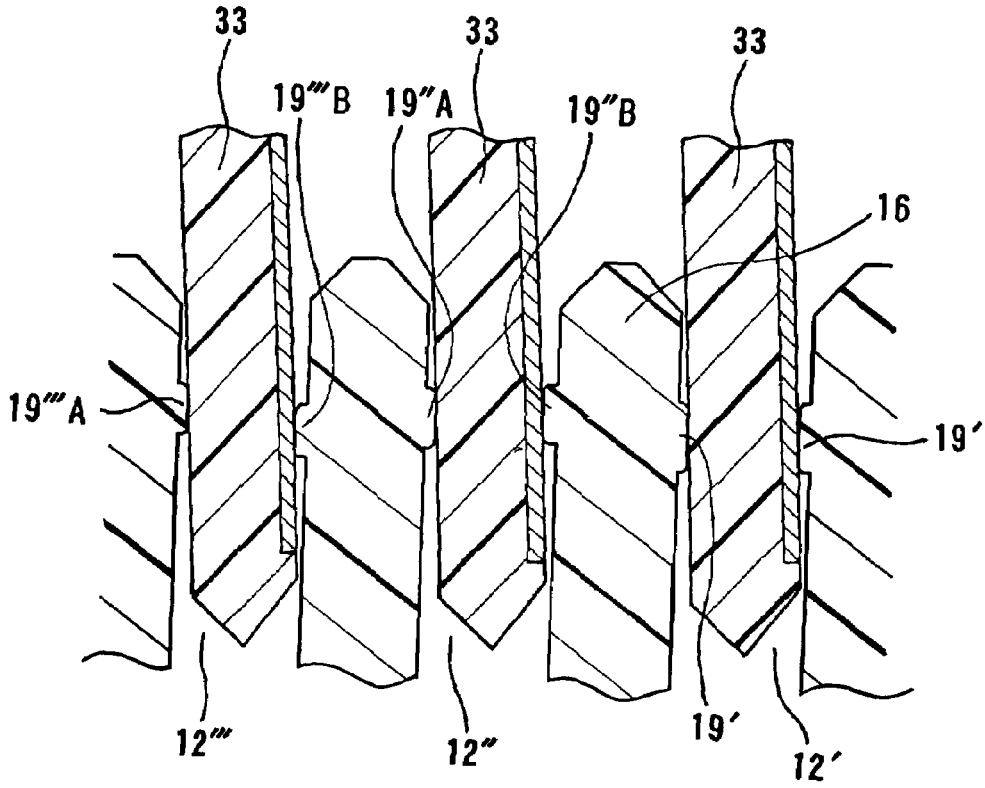
FIG. 5 is a schematic view showing a process of assembling the middle electrical connector according to the embodiment of the present invention.

In FIG. 5, the protrusion 19' has a flat surface section such as an approximate trapezoid. The protrusion 19' is provided on the right and left inner wall surfaces of the receiving groove 12' situated in the right side symmetrically. Accordingly, a contact area between the protrusion 19' and the middle member 33 is enlarged and strength of the protrusion 19' is increased.

Further, heights (entry amounts to an inside of the receiving groove) of the protrusions 19"A and 19"B are different. The protrusions 19"A and 19"B are provided in the left and right inner walls of the receiving groove 12" situated in a center of the FIG. 5. Accordingly, the different protrusions may be used depending on contact conditions. That is, one of the protrusions may be used depending on whether the mating member to contact is the terminal or the shielding plate.

Further, the protrusions 19'"A and 19'"B are displaced in a top-to-bottom direction. The protrusions 19'"A and 19'"B are provided on the left and right inner wall surfaces of the receiving groove 12'" situated in the left side of FIG. 5. However, the protrusions 19'"A and 19'"B are overlapped with each other in the direction. The overlapped portion functions as a supporting point. The contact portion 15A of the terminal 15 of the board electrical connector 10 is situated in the overlapped portion in the top-to-bottom direction.

The disclosure of Japanese Patent Application No. 2007-006024, filed on Jan. 15, 2007 is incorporated in the application by reference.

While the invention has been explained with reference to the specific embodiments of the invention, the explanation is illustrative and the invention is limited only by the appended claims.

What is claimed is:

1. A board electrical connector to be connected to a middle electrical connector having a middle member, comprising:

a housing including a receiving groove for receiving the middle member, said housing further including a protrusion protruding into the receiving groove by a first length as a pivot so that the middle member can be inclined around the protrusion when the middle member is inserted into the receiving groove; and a terminal including a contact portion at a position corresponding to the protrusion for contacting with a pad portion of the middle member, said contact portion protruding into the receiving groove by a second length larger than the first length; wherein said protrusion is situated at a same position as a top portion of said contact portion in a top-to-bottom direction.

2. The board electrical connector according to claim 1, wherein said housing includes the protrusion at a position between the terminal and an adjacent terminal.

3. The board electrical connector according to claim 1, wherein said terminal further includes a first terminal and a second terminal disposed on both inner sidewalls of the receiving groove.

4. The board electrical connector according to claim 3, wherein said first terminal and said second terminal are arranged alternately along a longitudinal direction of the receiving groove.

5. The board electrical connector according to claim 1, wherein said housing further includes a plurality of dividing walls to form the receiving groove therebetween, said protrusion being disposed on both sides of each of the dividing walls.

6. The board electrical connector according to claim 1, wherein said protrusion extends in a direction perpendicular to a longitudinal direction of the terminal.

7. The board electrical connector according to claim 6, wherein said protrusion has a semi-circular column shape.

8. The board electrical connector according to claim 6, wherein said protrusion has an approximate trapezoid shape.

9. An electrical connector assembly comprising:

a middle electrical connector including a middle housing and a middle member disposed in the middle housing, said middle member including a pad portion; and a board electrical connector including a housing and a terminal, said housing including a receiving groove for receiving the middle member, said housing further including a protrusion protruding into the receiving groove by a first length as a pivot so that the middle member can be inclined around the protrusion when the middle member is inserted into the receiving groove, said terminal including a contact portion at a position corresponding to the protrusion for contacting with the pad portion, said contact portion protruding into the receiving groove by a second length larger than the first length; wherein said protrusion is situated at a same position as a top portion of said contact portion in a top-to-bottom direction.

10. The electrical connector assembly according to claim 9, wherein said middle member further includes a board having two edge portions extending in parallel, said pad portion being disposed at a plurality of positions along the two edge portions.

11. The electrical connector assembly according to claim 10, wherein said middle member further includes a lead portion connecting the pad portions disposed at the two edge portions.

12. The electrical connector assembly according to claim 9, wherein said middle member further includes a shielding plate on a surface thereof opposite to the pad portion.

13. The electrical connector assembly according to claim 12, wherein said terminal further includes a first terminal and a second terminal disposed on both inner sidewalls of the receiving groove, said first terminal contacting with the pad portion, said second terminal contacting with the shielding plate.

14. The board electrical connector according to claim 9, wherein said housing further includes a plurality of dividing walls to form the receiving groove therebetween, said protrusion being disposed on both sides of each of the dividing walls.

15. The board electrical connector according to claim 9, wherein said protrusion extends in a direction perpendicular to a longitudinal direction of the terminal.

16. The board electrical connector according to claim 15, wherein said protrusion has a semi-circular column shape.

17. The board electrical connector according to claim 15, wherein said protrusion has an approximate trapezoid shape.

* * * * *